US010626759B2

(12) United States Patent
Smerczak

(10) Patent No.: US 10,626,759 B2
(45) Date of Patent: Apr. 21, 2020

(54) CAM PHASER BETWEEN CAM BEARINGS

(71) Applicant: BorgWarner Inc., Auburn Hills, MI (US)

(72) Inventor: John R. Smerczak, Ortonville, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 16/282,792

(22) Filed: Feb. 22, 2019

(65) Prior Publication Data

US 2019/0264585 A1 Aug. 29, 2019

Related U.S. Application Data

(60) Provisional application No. 62/635,576, filed on Feb. 27, 2018.

(51) Int. Cl.

| | |
|---|---|
| ***F01L 1/34*** | (2006.01) |
| ***F01L 1/26*** | (2006.01) |
| ***F01L 1/24*** | (2006.01) |
| ***F01L 1/344*** | (2006.01) |

(Continued)

(52) U.S. Cl.

CPC ..... *F01L 1/267* (2013.01); *F01L 1/24* (2013.01); *F01L 1/3442* (2013.01); *F01L 2001/0475* (2013.01); *F01L 2001/0476* (2013.01); *F01L 2013/0052* (2013.01); *F01L 2250/02* (2013.01); *F01L 2250/04* (2013.01); *F01L 2800/16* (2013.01)

(58) Field of Classification Search

CPC . F01L 1/24; F01L 1/267; F01L 1/3442; F01L 2800/16; F01L 2250/04; F01L 2250/02; F01L 2013/0052; F01L 2001/0476; F01L 2001/0475

See application file for complete search history.

(56) References Cited

U.S. PATENT DOCUMENTS 5,161,493 A 11/1992 Ma
5,669,343 A * 9/1997 Adachi ..... F01L 1/34406 123/90.17
6,725,817 B2 4/2004 Methley et al.

(Continued)

FOREIGN PATENT DOCUMENTS

JP 2001263025 A 9/2001
WO 2007116294 A2 10/2007

*Primary Examiner* — Zelalem Eshete

(74) *Attorney, Agent, or Firm* — Reising Ethington P.C.

(57) ABSTRACT

A variable camshaft timing assembly that comprises a hub including at least one vane extending radially-outwardly away from a center axis; an elongated camshaft sleeve, configured to be received at least partially by an inner cavity of a camshaft, having a substantially annular outer surface including a distal bearing section, an end bearing section, and a hub section: the distal bearing section configured to be positioned radially-inwardly from and concentric with a distal bearing of the camshaft and to provide support to the distal bearing; the end bearing section, axially spaced from the distal bearing section, configured to be positioned radially-inwardly from and concentric with an end bearing of the camshaft and to provide support to the end bearing; and the hub section, configured to engage the hub, located axially between the distal bearing section and the end bearing section.

15 Claims, 2 Drawing Sheets

(51) Int. Cl.
*F01L 1/047* (2006.01)
*F01L 13/00* (2006.01)

(56) References Cited

U.S. PATENT DOCUMENTS

| | | | |
|---|---|---|---|
| 6,928,971 | B2 | 8/2005 | Knecht et al. |
| 7,284,517 | B2 | 10/2007 | Lancefield et al. |
| 7,506,623 | B2 | 3/2009 | Schafer et al. |
| 7,765,967 | B2 | 8/2010 | Kira |
| 8,051,818 | B2 | 11/2011 | Myers et al. |
| 8,113,159 | B2 | 2/2012 | Myers et al. |
| 8,187,106 | B2 | 5/2012 | Muenich et al. |
| 8,201,528 | B2 | 6/2012 | Knecht et al. |
| 8,336,512 | B2 | 12/2012 | Myers et al. |
| 8,375,906 | B2 | 2/2013 | Myers et al. |
| 8,459,220 | B2 | 6/2013 | Comello |
| 8,689,755 | B2 | 4/2014 | Schneider et al. |
| 9,797,278 | B2 | 10/2017 | Flender et al. |
| 2015/0176442 | A1 | 6/2015 | Kwak et al. |
| 2017/0138228 | A1 | 5/2017 | Miyachi et al. |
| 2017/0159512 | A1 | 6/2017 | Flender et al. |
| 2017/0159791 | A1 | 6/2017 | Flender et al. |
| 2018/0030862 | A1 | 2/2018 | Weber et al. |
| 2018/0073655 | A1 | 3/2018 | Miyachi et al. |
| 2018/0087410 | A1 | 3/2018 | Cecil |

* cited by examiner

CAM PHASER BETWEEN CAM BEARINGS

CROSS-REFERENCE TO RELATED APPLICATIONS

This application claims the benefit of U.S. Patent Application No. 62/635,576 filed on Feb. 27, 2018, the disclosure of which is herein incorporated by reference in its entirety.

TECHNICAL FIELD

The present application relates to internal combustion engines and, more particularly, to variable camshaft timing used with internal combustion engines.

BACKGROUND

Internal combustion engines (ICE) open and close valves as part of the combustion process. Typically, one or more camshafts are rotationally coupled with a crankshaft via an endless loop that transmits rotational force from the crankshaft to the camshaft(s). In the past, the angular position of the crankshaft relative to the camshaft(s) has been fixed. But more recently, variable camshaft timing in the form of camshaft phasers (or simply a "cam phaser") has been used to vary or alter the angular position of the camshaft relative to the crankshaft(s). Depending on a variety of factors, engine operation can be optimized by changing, either advancing or retarding, the angular position of the camshaft(s) relative to the crankshaft. This can also be referred to as changing the phase of the camshaft(s). One portion of the camshaft phaser includes a camshaft sprocket rotationally coupled to the crankshaft via the endless loop and another portion of the camshaft phaser is coupled to the camshaft. The camshaft phaser can change an angular position of one portion of the camshaft phaser relative to another portion of the camshaft phaser in a variety of different ways. For example, the camshaft phaser can be hydraulically-controlled such that a hub with one or more vanes is angularly displaced by a fluid to advance or retard timing.

But implementing variable camshaft timing on engines using camshaft phasers involves a number of challenges. Engines sometimes use camshafts and phasers that are designed to tolerate some amount of radial and/or axial movement within the engine. When the engine is assembled with a camshaft phaser coupled to the camshaft, the endless loop, such as a chain, rotationally connects a crankshaft sprocket attached to the crankshaft with a camshaft sprocket attached to the camshaft. Tension from the endless loop exerted on the camshaft sprocket can pivot the camshaft and possibly some of the camshaft phaser components about an end bearing of the camshaft causing unwanted interference and binding. It would be helpful to prevent the camshaft and camshaft phaser from experiencing the unwanted interference and binding.

SUMMARY

In one embodiment, a variable camshaft timing assembly that comprises a hub including at least one vane extending radially-outwardly away from a center axis; an elongated camshaft sleeve, configured to be received at least partially by an inner cavity of a camshaft, having a substantially annular outer surface including a distal bearing section, an end bearing section, and a hub section: the distal bearing section configured to be positioned radially-inwardly from and concentric with a distal bearing of the camshaft and to provide support to the distal bearing; the end bearing section, axially spaced from the distal bearing section, configured to be positioned radially-inwardly from and concentric with an end bearing of the camshaft and to provide support to the end bearing; and the hub section, configured to engage the hub, located axially between the distal bearing section and the end bearing section.

In another embodiment, a variable camshaft timing assembly that comprises a hub including a center aperture and at least one vane extending radially-outwardly away from a center axis; an elongated camshaft sleeve, configured to be received at least partially by an inner cavity of a camshaft, having a substantially annular outer surface including a distal bearing section, an end bearing section, and a hub section: the distal bearing section configured to be positioned radially-inwardly from and concentric with a distal bearing of the camshaft and to provide support to the distal bearing; the end bearing section, axially spaced from the distal bearing section, configured to be positioned radially-inwardly from and concentric with an end bearing of the camshaft and to provide support to the end bearing; the hub section, located axially between the distal bearing section and the end bearing section, configured to engage the hub to prevent axial displacement between the hub and the elongated camshaft sleeve; and a camshaft sprocket, coaxial with the center axis, that includes an end bearing surface and engages with a distal end of the elongated camshaft sleeve.

In yet another embodiment, a variable camshaft timing assembly comprises a hub including a center aperture and at least one vane extending radially-outwardly away from a center axis; an elongated camshaft sleeve, configured to be received at least partially by an inner cavity of a camshaft, having a substantially annular outer surface including a distal bearing section, an end bearing section, and a hub section: the distal bearing section configured to be positioned radially-inwardly from and concentric with a distal bearing of the camshaft and to provide support to the distal bearing; the end bearing section, axially spaced from the distal bearing section, configured to be positioned radially-inwardly from and concentric with an end bearing of the camshaft and to provide support to the end bearing; the hub section located axially between the distal bearing section and the end bearing section inside of the center aperture of the hub; a camshaft sprocket that is coaxial with the center axis and engages with a distal end of the elongated camshaft sleeve; and a retention device received by the camshaft sleeve to axially constrain the hub and camshaft sprocket relative to the camshaft sleeve, wherein the camshaft sleeve, the hub, and the camshaft sprocket resist angular displacement relative to each other.

DETAILED DESCRIPTION

Figure 1:
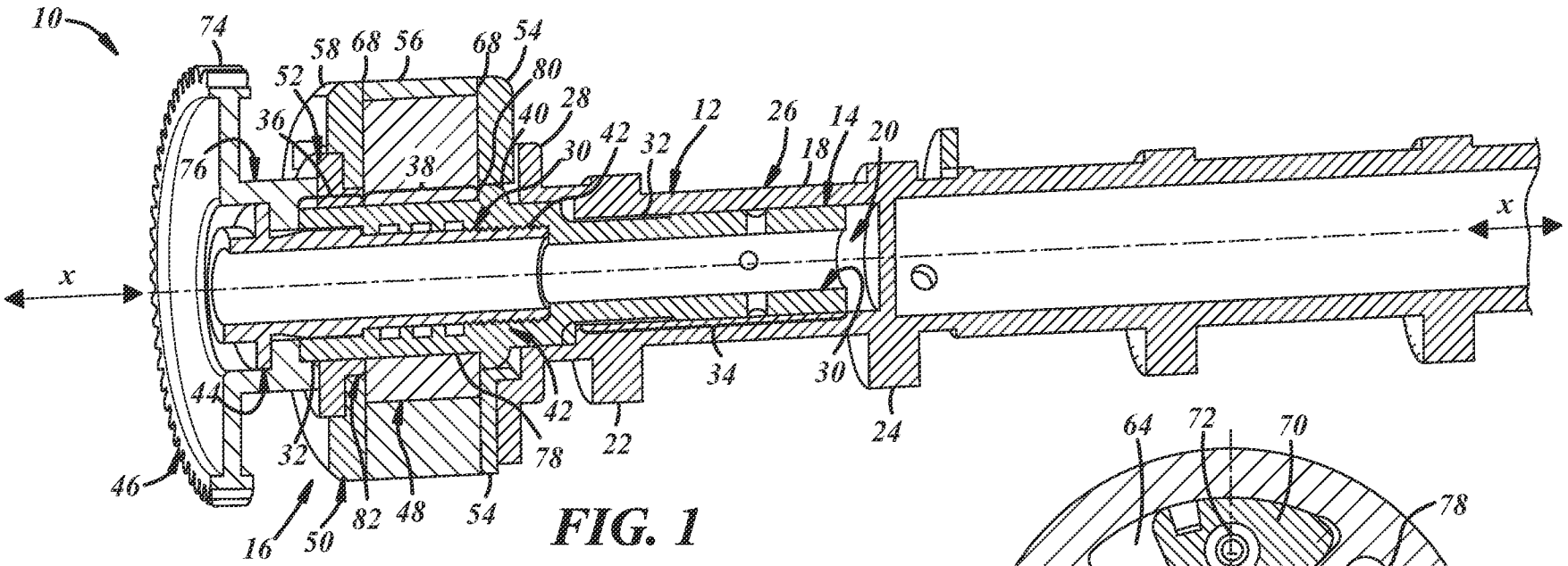
FIG. 1 is a perspective cross-sectional view depicting an implementation of a variable camshaft timing assembly and a camshaft.

As noted above, past assemblies of a variable camshaft timing (VCT) device (e.g., a camshaft phaser) and a camshaft in which the camshaft and elements of the cam phaser have axial and radial tolerances can pivot about the end bearing. The axial and radial tolerances can aid assembly of cam phaser components as an axial stack and installation with an ICE. The tension from an endless loop about the sprocket can pivot the elements of the cam phaser and/or the camshaft into interference with other parts thereby causing the cam phaser, the camshaft, or both to bind. This interference can include bearing misalignment, hub and vane(s) of the cam phaser interfering with a housing, or both.

A VCT assembly used with a camshaft of an internal combustion engine (ICE) can prevent the misalignment and interference described above. The VCT assembly includes an elongated camshaft sleeve and all or some portion of a hydraulically-controlled camshaft phaser. Elements of the hydraulically-controlled camshaft phaser can be assembled together with the elongated camshaft sleeve and installed in an ICE to prevent tipping or pivoting about the end camshaft bearing and unwanted binding. In one implementation, the elongated camshaft sleeve has a substantially annular outer surface, an inner cavity having a substantially annular inwardly-facing surface extending a length of the sleeve to be concentric with an end bearing and a distal bearing, and a shoulder extending radially outwardly from the outer surface of the sleeve. The outer surface of the camshaft sleeve can be configured to slidably receive the hub and vanes of a camshaft phaser so that an end surface of the hub engages with the shoulder to not only prevent axial movement but rotational movement as well. When the hub engages with the shoulder, an end bearing section, a distal bearing section, and a camshaft receiving section are exposed on the outer surface of the camshaft sleeve. A camshaft sprocket having an end bearing outer surface functioning as an end bearing of the camshaft can be coupled to an end of the camshaft sleeve that is proximate to the end bearing section. A retaining device can engage with the camshaft sleeve to axially inhibit movement of the hub and the camshaft sprocket with respect to the camshaft sleeve.

The VCT assembly, including the camshaft sleeve, the hub, and the camshaft sprocket can be combined with a camshaft. An end of the camshaft sleeve opposite to the camshaft sprocket can be slidably received by a hollow cavity within the camshaft. A cam phaser housing can be fixedly attached to the camshaft sleeve and the hub may be received within the cam phaser housing. The VCT assembly can include one section of the camshaft sleeve included with the camshaft sprocket supporting the end bearing and another section of the camshaft sleeve supporting a camshaft bearing distal to the end bearing and included with the camshaft. The hydraulically-controlled camshaft phaser may then be located axially in between the end camshaft bearing and another camshaft bearing located distal to the end camshaft bearing. The camshaft phaser sleeve can support the camshaft at both the end camshaft bearing as well as the distal camshaft bearing at axial positions along the sleeve that are concentric with and radially-inward from the end camshaft bearing and the distal camshaft bearing. The camshaft phaser sleeve then provides support for the camshaft and prevents the camshaft and/or the phaser from pivoting or tipping about the end bearing.

Turning to FIG. 1, an implementation of a VCT assembly 10 used in an internal combustion engine (ICE) is shown together with a camshaft 12 in a perspective cross-sectional view. The VCT assembly 10 in this implementation includes a camshaft sleeve 14 and a hydraulically-controlled camshaft phaser 16. The camshaft 12 has an outer surface 18 and an inner cavity 20 open at at least one end having a substantially annularly-shaped surface that faces radially inwardly. The outer surface 18 of the camshaft 12 includes a first lobe 22, a second lobe 24, a distal bearing surface 26, and a camshaft shoulder 28. The first lobe 22 and second lobe 24 act on valves stems (not shown) connected to valves to momentarily bias the valves open against the force of a valve spring as the camshaft 12 rotates. The camshaft shoulder 28 can be an annular flange fixedly attached to an end of the camshaft 12 proximate the inner cavity 20. The shoulder 28 can be implemented as an asymmetrically-shaped flange with one flange portion extending further from a center axis (x) relative to another flange portion. The inner cavity 20 can include an axial length having one diameter and another axial length nearer the camshaft sleeve 14 having a larger diameter. The transition between the smaller and larger diameters can prevent the axial movement of the camshaft sleeve 14 relative to the camshaft 12.

The camshaft sleeve 14 includes a substantially annular inner surface 30 and a substantially annular outer surface 32. The outer surface 32 includes a distal bearing section 34, an end bearing section 36, and a hub section 38. When the camshaft 12 is received by the inner cavity 20 of the camshaft 12, the distal bearing section 34 is positioned radially-inwardly from and concentric with the distal bearing surface 26 of the camshaft 12. The end bearing section 36 is axially spaced from the distal bearing section 34 and positioned radially-inwardly from and concentric with an end bearing of the camshaft 12 when the camshaft sleeve 14 is received by the inner cavity 20 of the camshaft 12. In this implementation, the distal bearing section 34 has a different outer diameter than the end bearing section 36. The transition between the diameter of the distal bearing section 34 and the end bearing section 36 can engage the transition between the smaller and larger diameters of the inner cavity 20 of the camshaft 12 to prevent the axial movement of the camshaft 12 relative to the camshaft sleeve 14. A sleeve shoulder 40 can extend radially outwardly from the outer surface 18 of the camshaft sleeve 14. More specifically, the sleeve shoulder 40 can be a flange that abuts hub of the hydraulically-controlled camshaft phaser 10. This will be discussed in more detail below.

The inner surface 30 of the camshaft sleeve 14 includes one or more securing features 42 that engage a retention device 44 to secure a camshaft sprocket 46 to an end of the sleeve 14 and also prevent axial movement of a plurality of elements of the VCT assembly 10. In this implementation, the securing feature 42 is a set of threads that engage with corresponding threads on the retention device 44. The retention device 44 can be a hollow bolt that extends along a length of the camshaft sleeve 14 of the inner cavity having the larger diameter. An end of the hollow bolt can abut or engage the transition between the smaller and larger diameters of the inner cavity when the VCT assembly 10 is assembled. One or more annular grooves can encircle or at least partially encircle the inner surface 30 of the camshaft sleeve 14 and communicate fluid to a spool valve (not shown). In this implementation, the hydraulically-controlled camshaft phaser 16 can use a cam-torque assisted design in which one groove is used to supply oil to the phaser, another groove is used to selectively communicate oil to an advance chamber of the phaser, and yet another groove is used to selectively communicate oil to a retarding chamber of the phaser. The spool valve can axially slide into the hollow portion of the bolt to control advancing or retarding camshaft phase. A spool valve can selectively move along the x axis to direct fluid through one or more of the grooves while preventing the flow of fluid to another groove. While the spool valve in this embodiment is shown to be located concentric and radially-inward relative to the retention feature 44, other implementations are possible in which a valve controlling the hydraulically-controlled phaser 16 is located remotely from the VCT assembly 10.

The hydraulically-controlled camshaft phaser 16 includes a hub 48 with one or more vanes, a housing 50 that receives the hub 48 and vanes, a thrust plate 52, and a camshaft sprocket 46. The housing 50 can be assembled from an end plate 54, an outer housing 56, and a front plate 58. The end plate 54 can be a flange that fixedly attaches to the camshaft shoulder 28 so that the end plate 54 and the camshaft 12 rotate together. The end plate 54 can have an inner diameter and an outer diameter. The inner diameter of the end plate 54 can be sized to closely conform to an outside surface 32 of the camshaft sleeve 14. In this implementation, the inner diameter is concentric with and closely conforms to a radially outwardly extending surface of the sleeve shoulder 40. The outer housing 56 can be annularly shaped such that it has an axial length extending along the x-axis that is longer than an axial length of the hub 48 along the x-axis.

The front plate 58 can be a flange with an inner diameter and an outer diameter. The inner diameter can be sized to allow the camshaft sleeve 14 to pass through while the outer diameter is sized to abut an end of the outer housing 56 of the housing 50. At each end 68, the outer housing 56 can include locating features, such as slots or pins, that engage with recessed features in the front plate 58 and end plate 54 to rigidly secure the front plate 58, outer housing 56, and end plate 54 together to form the housing 50. In some implementations, a thrust plate 52 can be included so that it abuts the front plate 58. The thrust plate 52 can include an inner diameter that is sized to allow the camshaft sleeve 14 to pass through it. It should be appreciated that this is one implementation of a hydraulically-controlled camshaft phaser 16 and that other implementations including fewer or additional elements are possible. The VCT assembly 10 can be implemented using either oil-pressure actuated or cam-torque actuated variable camshaft phasers.

Figure 2:
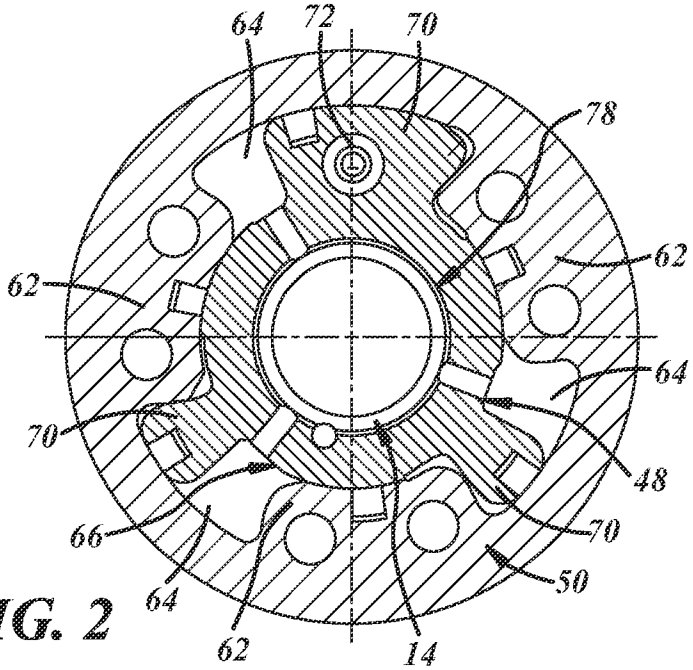
FIG. 2 is a profile cross-sectional view depicting a portion of a variable camshaft timing assembly.

A cross section of the hub 48 and housing 50 is shown in FIG. 2 as these elements fit together when assembled. The hub 48 in this implementation include three vanes 70 that extend radially-outwardly from a base 66 of the hub 48 into the individual phasing chambers 64. However, it should be appreciated that any number of vanes could be used to implement the hub 48. Pressurized fluid, such as engine oil, can be supplied to one side of the vanes 70 to advance the camshaft 12 and another side of the vanes 70 to retard the camshaft 12. The grooves included in the camshaft sleeve 14 communicate fluid to one side of the vanes 70 for advancing timing and another side for retarding timing. At least one of the vanes 70 includes a locking pin 72 that prevents the hub 48 from rotating relative to the housing 50. A plurality of radially-inwardly extending features 62 define a plurality of chambers 64 that receive fluid for advancing or retarding the camshaft 12. The features 62 extend to abut the base 66 of the hub 48 and permit angular movement of the hub 48 relative to the housing 50 while preventing fluid flow between chambers 64.

Turning back to FIG. 1, the camshaft sprocket 46 can include a plurality of teeth 74 forming a gear on a circumferential surface. The plurality of teeth 74 can be engaged by an endless loop (not shown), such as a chain or a belt, that also engages a crankshaft sprocket (not shown) that transmits rotational energy to the camshaft sprocket 46 and the camshaft 12. The camshaft sprocket 46 also includes an outer or end bearing 76 for the camshaft 12. The surface of the end bearing 76 is annular and extends in an axial direction along the x-axis. The end bearing 76 of the camshaft sprocket 46 rests in the end bearing of the cylinder head of the ICE when the VCT assembly 10 is assembled with the ICE.

The VCT assembly 10 can include one group of elements that move angularly relative to another group of elements. In one implementation, a first group of elements includes the camshaft 12 and the housing 50 whereas a second group of elements includes the camshaft sleeve 14, the hub 48, the thrust plate 52, the camshaft sprocket 46, and the retention device 44. In response to the selective flow of fluid into the advancing or retarding chamber, the first group of elements can be angularly displaced, advanced or retarded, relative to the second group of elements. The camshaft 12 can be securely linked to the housing 50 via a variety of attachment methods, such as using bolts or through welding. And the second group of elements can be assembled around the camshaft sleeve 14. The hub 48 can be slid onto the camshaft sleeve 14 so that a surface of a center aperture 78 of the hub 48 closely conforms to and contacts the outer surface of the camshaft sleeve 14 and an end 80 of the hub 48 abuts the sleeve shoulder 40. The housing 50 can be assembled around the hub 48 and the vanes. The distal bearing section 34 of the camshaft sleeve can be slidably received by the inner cavity 20 of the camshaft 12 so that an outer surface 32 of the camshaft sleeve 14 contacts the inner surface 30 of the inner cavity 20 of the camshaft 12. It should be appreciated that the camshaft sleeve 14 can rotate relative to the camshaft 12. Axial movement between the camshaft sleeve 14 and the camshaft 12 can be prevented by the transition between the smaller and larger diameters within the inner cavity 20 of the camshaft 12, which abuts the transition between the diameter of the distal bearing section 34 and the diameter of the end bearing section 36, and/or the hub 48 abutting the front plate 58. The outer housing 56 and end plate 54 can then be axially slid over the camshaft sleeve 14 to enclose the hub 48. The thrust plate 52 can be axially slid over the camshaft sleeve 14 followed by the camshaft sprocket 46. The retention device 44 can then engage with the securing features 42, in this implementation the hollow bolt engaging the threads of the sleeve 14. As the hollow bolt engages the threads and is torqued to a pre-defined torque value, the hub 48, thrust plate 52, and camshaft sprocket 46 are axially compressed against the sleeve shoulder 40 of the camshaft sleeve 14. An annular flange 82 extending from the thrust plate 52 can provide spacing and clearance between the hub 48 and the housing 50 permitting the hub 48 along with the camshaft sleeve 14, the thrust plate 52, the camshaft sprocket 46, and the retention device 44 to rotate relative to the camshaft 12 and housing 50.

Figure 3:
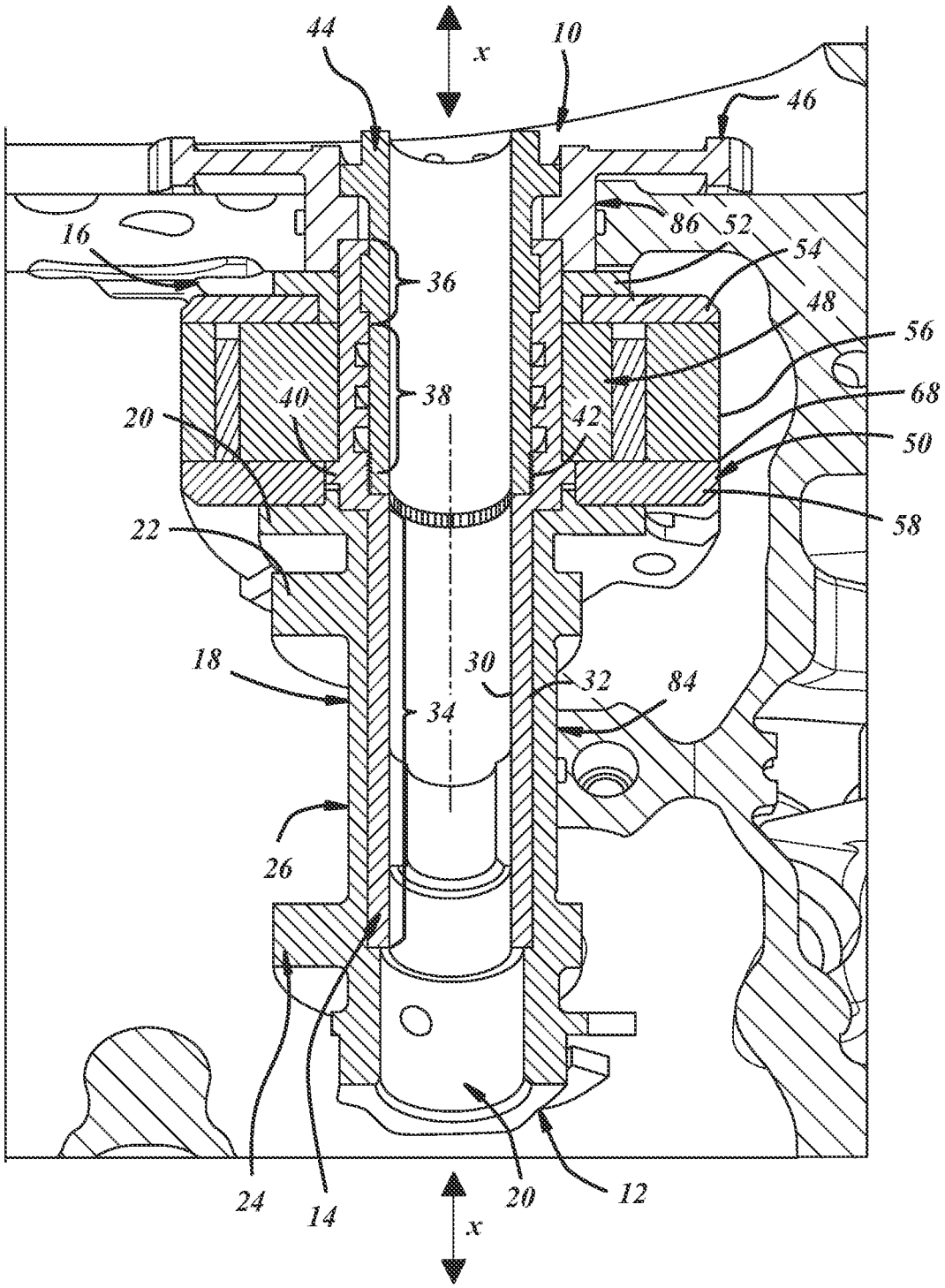
FIG. 3 is a perspective cross-sectional view depicting an implementation of a variable camshaft timing assembly and a camshaft in an internal combustion engine.

The VCT assembly 10 and the camshaft 12 can then be installed in the ICE such that the distal bearing surface 26 of the camshaft 12 rests in a distal bearing 84 of the ICE and the end bearing surface 76 of the camshaft sprocket 46 rests in the end bearing 86 of the ICE. This is shown in FIG. 3 in more detail. The VCT assembly 10 and camshaft 12 is shown in cross-section from a perspective view without the bearing caps installed.

The camshafts combined with the VCT assembly 10 described herein can be removed and reinstalled with without removing the endless loop from the camshaft sprocket or removing the camshaft sprocket from the end bearing. Removing the camshaft can be carried out by removing a cam cover (not shown) to expose the camshafts in the ICE. The retention device can be removed from the camshaft sleeve permitting the camshaft, the housing, the hubbed vanes, and the camshaft sleeve to be moved axially from the camshaft sprocket and lifted away from and out of the ICE. The camshaft sprocket can remain positioned in the end bearing with the endless loop engaging both the crankshaft sprocket and the camshaft sprocket. The removal of the VCT assembly 10 and camshaft from the ICE can be performed to combine a different camshaft with the VCT assembly 10 for installation in the ICE. The ability to leave the camshaft sprocket in the end bearing connected to crankshaft sprocket via the endless loop while removing the camshaft maintains the angular position of the VCT assembly 10 and camshaft relative to the crankshaft during reinstallation without performing a recalibration of timing between the crankshaft and camshaft. Reinstallation of the VCT assembly 10 with a camshaft can involve aligning the camshaft sleeve with the camshaft sprocket via alignment features identifying the proper angular position of the camshaft sleeve relative to the camshaft sprocket, such as a spline engaging a groove or two alignment marks, located on the camshaft sprocket and camshaft sleeve. Once the camshaft sleeve is properly positioned relative to the camshaft sprocket, the retention device can be reinstalled with respect to the camshaft sleeve and torqued to the predefined torque value.

It is to be understood that the foregoing is a description of one or more embodiments of the invention. The invention is not limited to the particular embodiments) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiments) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing assembly comprising:

a hub including one or more vanes extending radially-outwardly away from a center axis;

an elongated camshaft sleeve, configured to be received at least partially by an inner cavity of a camshaft, having a substantially annular outer surface including a distal bearing section, an end bearing section, and a hub section:

the distal bearing section configured to be positioned radially-inwardly from and concentric with a distal bearing of the camshaft and to provide support to the distal bearing;

the end bearing section, axially spaced from the distal bearing section, configured to be positioned radially-inwardly from and concentric with an end bearing of the camshaft and to provide support to the end bearing; and the hub section, configured to engage the hub, located axially between the distal bearing section and the end bearing section.

2. The variable camshaft timing assembly recited in claim 1, further comprising a camshaft including an inner cavity that receives the elongated camshaft sleeve.

3. The variable camshaft timing assembly recited in claim 2, wherein the camshaft further comprises a camshaft shoulder that is fixedly coupled with a housing of a hydraulically-controlled camshaft phaser.

4. The variable camshaft timing assembly recited in claim 1, wherein the elongated camshaft sleeve further comprises an inner surface with retention features that receives a retention device.

5. The variable camshaft timing assembly recited in claim 1, further comprising a hydraulically-controlled camshaft phaser axially positioned between the end bearing and the distal bearing.

6. A variable camshaft timing assembly comprising:

a hub including a center aperture and one or more vanes extending radially-outwardly away from a center axis;

an elongated camshaft sleeve, configured to be received at least partially by an inner cavity of a camshaft, having a substantially annular outer surface including a distal bearing section, an end bearing section, and a hub section:

the distal bearing section configured to be positioned radially-inwardly from and concentric with a distal bearing of the camshaft and to provide support to the distal bearing;

the end bearing section, axially spaced from the distal bearing section, configured to be positioned radially-inwardly from and concentric with an end bearing of the camshaft, and to provide support to the end bearing;

the hub section, located axially between the distal bearing section and the end bearing section, configured to engage the hub to prevent axial displacement between the hub and the elongated camshaft sleeve; and a camshaft sprocket, coaxial with the center axis, that includes an end bearing surface and engages with a distal end of the elongated camshaft sleeve.

7. The variable camshaft timing assembly recited in claim 6, further comprising a camshaft including an inner cavity that receives the elongated camshaft sleeve.

8. The variable camshaft timing assembly recited in claim 7, wherein the camshaft further comprises a camshaft shoulder that is fixedly coupled with a housing of a hydraulically-controlled camshaft phaser.

9. The variable camshaft timing assembly recited in claim 6, wherein the elongated camshaft sleeve further comprises an inner surface with retention features that receives a retention device.

10. The variable camshaft timing assembly recited in claim 6, further comprising a hydraulically-controlled camshaft phaser axially positioned between the end bearing and the distal bearing.

11. A variable camshaft timing assembly comprising:

a hub including a center aperture and one or more vanes extending radially-outwardly away from a center axis;

an elongated camshaft sleeve, configured to be received at least partially by an inner cavity of a camshaft, having a substantially annular outer surface including a distal bearing section, an end bearing section, and a hub section:

the distal bearing section configured to be positioned radially-inwardly from and concentric with a distal bearing of the camshaft and to provide support to the distal bearing;

the end bearing section, axially spaced from the distal bearing section, configured to be positioned radially-inwardly from and concentric with an end bearing of the camshaft and to provide support to the end bearing;

the hub section located axially between the distal bearing section and the end bearing section inside of the center aperture of the hub;

a camshaft sprocket that is coaxial with the center axis and engages with a distal end of the elongated camshaft sleeve; and a retention device received by the camshaft sleeve to axially constrain the hub and camshaft sprocket relative to the camshaft sleeve, wherein the camshaft sleeve, the hub, and the camshaft sprocket resist angular displacement relative to each other.

12. The variable camshaft timing assembly recited in claim 11, further comprising a camshaft including an inner cavity that receives the elongated camshaft sleeve.

13. The variable camshaft timing assembly recited in claim 11, wherein the camshaft further comprises a camshaft shoulder that is fixedly coupled with a housing of a hydraulically-controlled camshaft phaser.

14. The variable camshaft timing assembly recited in claim 11, further comprising a hydraulically-controlled camshaft phaser axially positioned between the end bearing and the distal bearing.

15. The variable camshaft timing assembly recited in claim 11, wherein the camshaft sprocket further comprises an end bearing surface that engages with a distal end of the elongated camshaft sleeve.

* * * * *